United States Patent [19]

Bacon, Jr. et al.

[11] Patent Number: 4,483,624

[45] Date of Patent: Nov. 20, 1984

[54] HIGH INTENSITY CONDITIONING MILL AND METHOD

[75] Inventors: Franklin C. Bacon, Jr., Macon; Robert L. Brooks, Gordon, both of Ga.

[73] Assignee: Freeport Kaolin Company, New York, N.Y.

[21] Appl. No.: 411,505

[22] Filed: Aug. 25, 1982

[51] Int. Cl.[3] ..... B01F 7/16

[52] U.S. Cl. ..... 366/293; 366/263; 366/307

[58] Field of Search ..... 366/292, 293, 263, 270, 366/262, 307, 264, 266, 244, 245, 247, 251, 302, 343

[56] References Cited

U.S. PATENT DOCUMENTS

| | | | |
|---|---|---|---|
| 1,285,061 | 11/1918 | Daman . | |
| 1,646,019 | 10/1927 | Forrester . | |
| 2,914,385 | 11/1959 | Massey | 366/307 |
| 3,339,897 | 9/1967 | Davis | 366/265 |
| 3,437,203 | 4/1969 | Nakamura | 209/169 |
| 3,491,880 | 1/1970 | Reck | 209/164 |
| 3,525,437 | 8/1970 | Kaeding et al. | 210/221 |
| 3,701,421 | 10/1972 | Maxwell | 209/164 |
| 3,730,341 | 5/1973 | Mames et al. | 209/164 |
| 3,864,438 | 2/1975 | Nagahama | 261/87 |
| 3,872,010 | 3/1975 | Nagahama | 210/219 |
| 4,287,054 | 1/1981 | Hollingsworth | 209/170 |

*Primary Examiner*—Robert W. Jenkins

*Attorney, Agent, or Firm*—Fisher, Christen & Sabol

[57] ABSTRACT

A high intensity conditioning mill for conditioning aqueous pulp containing particles of clay and mineral impurities preparatory to subjecting the pulp to froth flotation comprising a conditioning vessel for containing the body of aqueous pulp, a plurality of generally horizontal baffles mounted within said vessel and dividing the interior thereof into a plurality of chambers, each baffle being formed with a central, circular hole, inlet means for feeding aqueous pulp to the lowermost chamber, outlet means for removing conditioned aqueous pulp from the space above the uppermost baffle, a rotatable, generally vertical drive shaft centrally positioned to rotate in said vessel and extending generally concentrically through each hole in each baffle and a plurality of impellers mounted on said shaft and generally positioned within a hole of the horizontal baffle, the impellers being of a size relative to said holes sufficient to provide passageways for the aqueous pulp from each chamber to each adjacent chamber whereby the aqueous pulp is caused to flow from the lowermost chamber to the space above the uppermost baffle while being subjected to the action of the impellers.

4 Claims, 4 Drawing Figures

HIGH INTENSITY CONDITIONING MILL AND METHOD

BACKGROUND OF THE INVENTION

1. Field of the Invention

This invention relates to the field of froth flotation of clay such as kaolin containing mineral impurities such as titanium dioxide and more specifically relates to an apparatus and method for conditioning an aqueous pulp of clay particles and mineral impurities preparatory to subjecting the pulp to froth flotation.

2. Prior Art

It is customary, when clay is subjected to froth flotation, to first condition a slurry of the clay by adding to it activators such as calcium chloride and calcium oxide and oleic acid and subjecting the resulting mixture to very severe agitation so as to impart to the slurry an input of a substantial amount of horsepower hours, i.e. at least twenty-five horsepower hours of energy per ton of clay solids. It is believed that the titanium dioxide mineral impurity contains hydroxyl groups which, after a sufficient energy input, react with the calcium ion introduced by the above-mentioned activators to satisfy one of the valences of the calcium ion, the other valence being satisfied by reaction with the oleic acid anion to chemically bond the oleic acid molecule, i.e. the oleate to the titanium dioxide mineral impurity particle. The oleate renders the particle hydrophobic and more compatible with air bubbles which are subsequently introduced during the froth flotation phase of the process. It is furthermore believed that violent or prolonged agitation promotes the reaction of calcium ion with the titanium dioxide particle followed by reaction with the oleic acid.

Heretofore, in many cases conditioning was caused to take place within the flotation vessel prior to subjecting the pulp to froth flotation. U.S. Pat. Nos. 1,285,061, 3,437,203 and No. 3,491,880 illustrate a flotation apparatus but fail to disclose or suggest a plurality of generally horizontal baffles having holes in which a plurality of impellers are rotated by a common drive shaft. The impellers employed in the apparatus of these patents are used for the purpose of not only agitating but also sucking air into the pulp.

U.S. Pat. Nos. 3,864,438 and 3,872,010 also disclose flotation machines which, however, utilize a double blade impeller which cooperates with a set of circularly disposed vanes. Neither of these patents discloses or suggests the use of a plurality of impellers positioned and adapted to rotate on a common shaft in holes provided in a plurality of generally horizontal baffles.

A disadvantage of the prior art processes of froth flotation to remove titanium impurities from kaolin type clays has been the use of relatively large amounts of reagents compared to those amounts used in the flotation process in which the conditioning device of this invention is used. A further disadvantage of the prior art is the necessity of adding the reagents in stages interspersed by extended periods of conditioning. The reagent dosage, method of addition and high energy input of the prior art was necessitated by the inefficient application of energy to the very fine particles of clay such that an insignificant amount of the titanium impurity is scrubbed off the clay particles and made available for extraction from the water suspension in the froth flotation process. As a result of this deficient conditioning, costly reagents are used in an excess amount and the suspension must be greatly diluted (to less than 20% by weight and as low as 5% by weight) to effect the thorough removal of these reagents, their reaction products, and the titanium mineral impurity. The very dilute suspension which emerges from the froth flotation process must then be dewatered to useful commercial concentrations. Dewatering equipment for such fine particle clays is quite expensive, both to purchase and operate. In sum, the deficient conditioning results in a significantly and unnecessarily higher cost for reagents, conditioning and dewatering.

SUMMARY OF THE INVENTION

This invention relates to a high intensity conditioning mill for conditioning an aqueous pulp containing particles of clay such as kaolin clay and color mineral impurities prior to subjecting the pulp to froth flotation or floating off the titanium mineral impurities by injecting a multitude of air bubbles into the pulp.

This invention provides a device uniquely well suited for conditioning very fine particle (100% less than 10 micrometers) minerals dispersed in water at concentrations of greater than 35% solids, although it is also effective in conditioning slurry at lower concentrations. A significant advantage of this device is the dissipation of less than 200 HP-HR/Ton of solids in a manner useful in a high solids (greater than 35% solids) froth flotation process.

In this invention, a conditioning device is described which so effectively scrubs the titanium mineral impurity from kaolin clays that (1) the level of reagents and inert particulates peculiar to the froth flotation process is reduced to a total of less than 6 pounds per ton of solids, (2) the concentration of the clay slurry throughout the froth flotation process can be maintained in excess of 35% by weight, (3) all conditioning reagents can be added at one time and one place, (4) total conditioning energy is reduced to less than 200 HP-HR/Ton of solids, and (5) titanium mineral impurities made available for extraction exceed 80% of the original impurity content in the clay.

The conditioning apparatus of this invention basically comprises a vessel adapted to contain a body of aqueous pulp. The interior of the vessel is divided into a number of chambers by means of generally horizontal baffles extending inwardly from the interior wall of the vessel. Each baffle has a hole generally in its central portion and each hole is aligned with each other hole. A common shaft extends generally vertically through the holes in the horizontal baffles. A plurality of impellers are rotatably mounted on the drive shaft such that an impeller is disposed within the hole of each baffle and extends below the baffle.

Each impeller is formed as a hollow drum open at the bottom and closed at the top and having as a side wall a multitude of spaced apart vanes around the periphery of the impeller. The vanes extend from the bottom to the top of the impeller. When the impeller is rotated, aqueous pulp is passed up through the open bottom and expelled centrifugally outwardly through the spaces between the vanes. The relative amount of each impeller extending above and below the generally horizontal baffle will determine to a substantial degree the recirculation rate of pulp within each chamber and the flow rate of pulp from one chamber to the chamber next above it. Thus, when the impeller extends about half way above and half way below the generally horizontal baffle plate, it is conceivable that the amount of pulp expelled into the chamber above the impeller is substantially equal to the amount expelled by the impeller into the chamber below the impeller. However, when the impeller is positioned so that the closed top of the impeller is almost at the same level as the generally horizontal baffle, very little pulp is expelled by the impellers into the upper chamber whereas almost all is recirculated back within the lower chamber. A feed pipe opens into the lowermost chamber for feeding pulp thereto. Conditioned pulp is withdrawn from the uppermost chamber of the vessel.

The clay/mineral to be conditioned is suspended in water at a concentration of ca. 35% solids, although lower or higher concentrations can be used. The suspension is admitted to the bottom of the working volume of the vessel and caused to move upward, passing through each impeller and in residence in each chamber (formed by the horizontal baffles). The suspension exits the working volume of the vessel through either an orifice or a launder at the surface of the liquid.

For example, the impeller of a specific device of this invention resembles a "squirrel cage" fan in configuration. The impeller is secured to the rotating shaft by means of a hub affixed to a round base plate. Perpendicular to the base plate and located circumferentially around the base plate are several flat or slightly curved bars. The number, angle from the radius, length, and curvature of these bars are pertinent to the effectiveness of application of this device. An effective and efficient peripheral speed for a blade of this type is ca. 730 meters/minute, although lesser or greater peripheral speeds are applicable under various conditions.

The conditioning device of this invention can be used as a single unit for batch operation or in multiples for series and/or parallel continuous operation.

As one specific illustration, the conditioning device of this invention is a vessel 1.22 meters in diameter, 2.44 meters high divided into six, roughly equal, chambers by horizontal baffles with an annular width of 0.4 meters. Mounted on the shaft are 5 impellers as described, each ca. 0.4 meters in diameter by about 0.25 meters high. The location of the impellers along the shaft is related to each baffle and so located as to yield the greatest scrubbing action for the lowest input of power. The impellers are rotated at ca. 730 meters per minute by a 125 horsepower electric motor.

A clay-water suspension was prepared with the appropriate reagents and at a concentration of 40% solids and was admitted to the bottom of the vessel through a vertical pipe mounted along the inside of the wall of the vessel. The suspension exited the vessel through an orifice in the vessel wall ca. 0.3 meters from the top of the vessel. The flow of the suspension through the vessel was sustained at a rate to allow a residence time of between 2 and 6 minutes in each chamber. The total input of energy was equivalent to ca. 150 HP-HR per ton of solids. The clay-water suspension was adequately conditioned to allow froth flotation at ca. 40% solids to effect removal of more than 80% of the titanium mineral present in the original clay.

Figure 1:
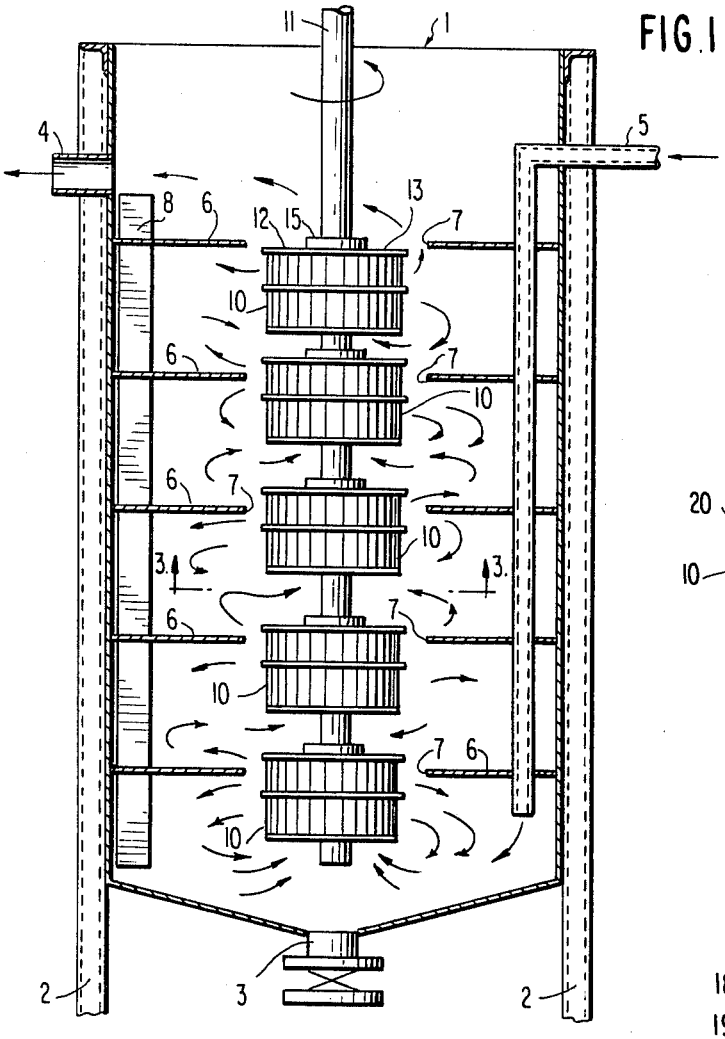
FIG. 1 is a sectional view in elevation of the conditioning mill of the present invention.
Figure 4:
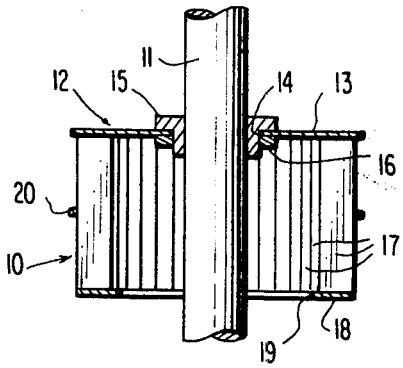
FIG. 4 is a sectional view taken on line 4–4 of FIG. 3.
Figure 3:
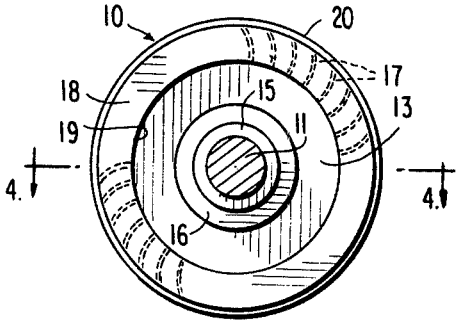
FIG. 3 is a fragmentary sectional view taken on line 3—3 of FIG. 1.
Figure 2:
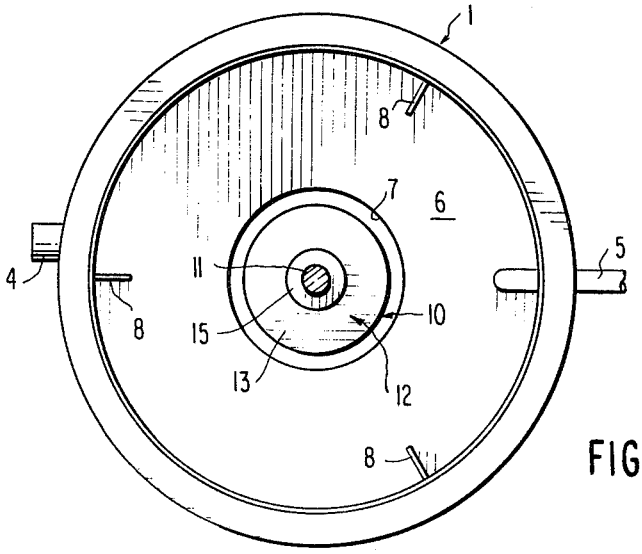
FIG. 2 is a plan view of the conditioner shown in FIG. 1.

Referring to the FIGS., a vessel 1 is shown supported by legs 2 and having a drain valve 3, an outlet pipe 4 and an inlet feed pipe 5 entering the upper wall of vessel 1 and extending downwardly to the lower portions of vessel 1 where the feed is discharged into the vessel. The vessel is also provided with a number of circular baffles 6 mounted on the interior wall of vessel 1 and extending generally horizontally from the vessel wall into the interior of the vessel. Each baffle 6 is provided with a centrally located circular hole 7. In addition, generally vertical baffles 8 are mounted on the inner wall of the vessel and extend from about just below the level of the outlet pipe 4 to the bottom of the vessel.

The impellers 10 are mounted on a generally vertical shaft 11 such that each impeller is positioned within the hole 7 of a baffle 6. The shaft 11 is drivably connected to a suitable motor or other turning force for rotating it at the desired rpm. Each impeller 10 is formed with an upper closed end 12 comprising a circular plate 13 having a concentric circular hole 14 through which a hub 15 passes, a circular ring 16 is mounted against the inner or under surface of the plate 13 and is bolted through the plate 13 to the hub 15. The hub 15 is suitably fixed to the shaft by means of keys and/or set screws. The impeller 10 is furthermore formed with generally vertical vanes 17 which can be curved or simply slanted relative to the radius. The upper end of each vane 17 is secured to the outer peripheral portions of upper circular plate 13 and the lower end of each vane 17 is secured to a lower circular plate 18. The lower circular plate 18 is formed with a large concentric hole 19 such that the bottom of the impeller is open permitting pulp to flow upwardly into the interior of the impeller. The vanes 17 are further reinforced with reinforcing ring 20 which is secured to the midsection of each vane.

The uppermost impeller 10 is mounted in hole 7 such that the closed upper end 12, i.e. upper circular plate 13 and hub 15 are substantially level with the uppermost baffle. In this position pulp being drawn up into the interior is thrown out sideways into the same chamber and little, if any, is thrown out into the space above the horizontal baffle 6.

All other impellers 10 mounted in the holes 7 of baffles 6 below the uppermost impeller are mounted in their respective holes such that a minor portion of the vanes 17 extend above the baffle in which the impeller is mounted. In the embodiment shown in the FIGS., the vanes 17 of all but the uppermost impeller extend for about one-quarter of their length above the plane of the baffle in which it is mounted and about three-quarters extends below said plane. In this manner, most of the pulp drawn up into the impeller into the chamber is flung out sideways into the same chamber and a small proportion of the pulp is thrust sideways into the upper chamber. The horizontal baffles 6 ensure that the pulp flows through the impellers. Of course, the impellers 10 can be raised or lowered in relation to their respective baffles and flow rates through the vessel 1 can be somewhat moderated by throwing more of the pulp back into the same chamber from which it was withdrawn.

Various modifications can be made to the apparatus as shown in the drawings. For example, the holes 7 in the baffles 6 need neither be circular nor concentric. The holes 7 can be of any configuration, e.g. square, triangular, hexagonal, pentagonal, etc. Furthermore, the holes 7 need not be precisely concentric as long as the impeller is free to rotate within the hole and the hole provides sufficient clearance for such free rotation. Furthermore, it is not essential that the drive shaft be concentric with each of the holes 7 and the baffles 6; the important criteria being that the relative sizes, configurations and positions of the drive shaft 11, the holes 7 and impellers 10 be such that the impellers freely rotate in the holes 7.

In addition, the baffles 6 need not be horizontal nor need they be flat. The baffles 6 can be corrugated, rough surfaced, pebble surfaced, ripple surfaced, conical or any other suitable shape. Furthermore, the baffles 6 need not be tightly sealed to the walls of vessel 1 and some leakage from one chamber to another other than through the holes 7 can be tolerated. As a matter of practicability, the vessel 1 is vertical; however, if a sealed system is used the vessel 1 can be horizontal in which case the drive shaft 11 is horizontal and the baffles 6 are vertical. In this case the upper end of the vessel 1 would have to be closed off and the drive shaft would operate through a suitable seal in the cover for the vessel 1.

Also, provision can be made for changing the location of each impeller 10 on the drive shaft 11 so that to adjust the proportion of the impeller extending below and above its corresponding baffle. In addition, if desired the drive shaft itself can be moved axially to adjust the position of the impellers 10 relative to the baffles 6.

The flow rate through vessel 1 can be varied over a wide range. For example, flow rates of about 15 to about 35 gallons per minute, preferably 20 to 30 gallons per minute, can be used. Representative residence times of the pulp in each chamber range from two to eight minutes. The flow rate from chamber to chamber is regulated by the position of the impeller 10 in relation to the holes 7 in the horizontal baffles 6 as well as by the rate of feed entering the vessel 1 through the feed pipes. The uppermost impeller 10 preferably is located with its closed upper end 12 at or slightly below the level of the uppermost baffle 6 which appears to avoid the formation of any substantial suction in the lowermost chamber and to avoid vigorous splashing of the pulp above the uppermost baffle 6. Other changes and modifications are possible.

What is claimed is:

1. Apparatus for conditioning an aqueous pulp containing particles of clay and mineral impurities preparatory to subjecting said pulp to froth flotation comprising:

a conditioning vessel adapted to contain a body of said aqueous pulp;

a plurality of generally horizontal baffles disposed within said vessel and dividing the interior of said vessel into a plurality of chambers, each said baffle being formed with a central, circular hole and being mounted on the inner wall of said vessel so that pulp travelling upwardly in said vessel must pass through the central hole in each baffle;

inlet means feeding aqueous pulp to the lower-most chamber;

outlet means for removing conditioned aqueous pulp from the space above the uppermost baffle;

a rotatable generally vertical drive shaft centrally positioned to rotate in said vessel and extending generally concentrically through each said hole in each said baffle; and a plurality of impellers each mounted for rotation on said shaft and generally positioned within each said hole of said horizontal baffles, each said impeller having a sidewall containing a plurality of spaced apart vertical vanes in the periphery thereof such that aqueous pulp is flung outwardly into said chamber, said impellers being of a size relative to said holes to sufficiently provide passageways for said aqueous pulp from chamber to the adjacent chambers whereby aqueous pulp is caused to flow from said lowermost chamber to the space above the uppermost baffle while being subjected to the action of said impellers.

2. Apparatus as claimed in claim 1 wherein said impellers each comprise a hollow drum open at the bottom and closed at the top and having as a side wall a plurality of spaced apart vanes extending from top to bottom around its periphery such that when the impeller is rotated, aqueous pulp is sucked up through said open bottom and expelled centrifugally outwardly through the spaces between said vanes.

3. Apparatus as claimed in claim 2 wherein the closed top of each impeller is positioned slightly above the top of the baffle in which it is mounted so that said impeller extends into two adjacent chambers.

4. Apparatus as claimed in claim 1 wherein a plurality of vertical baffles are positioned in said chambers adjacent the outer peripheries of said horizontal baffles.

* * * * *